US006155051A

United States Patent [19]

Williams

[11] Patent Number: 6,155,051

[45] Date of Patent: Dec. 5, 2000

[54] METHOD OF HEATING NATURAL GAS IN A CITY GATE STATION

[76] Inventor: Paul R. Williams, 5053 Mengel La., Hilliard, Ohio 43026

[21] Appl. No.: 09/295,489

[22] Filed: Apr. 20, 1999

[51] Int. Cl.[7] ..... F01K 17/00

[52] U.S. Cl. ..... 60/648; 60/650; 60/682

[58] Field of Search ..... 60/648, 650, 676, 60/682

[56] References Cited

U.S. PATENT DOCUMENTS

| | | | |
|---|---|---|---|
| 4,677,827 | 7/1987 | Shenoy et al. | 60/648 |
| 4,813,237 | 3/1989 | Sziics et al. | 60/648 X |
| 5,421,166 | 6/1995 | Allam et al. | 60/648 X |
| 5,582,012 | 12/1996 | Tunkel et al. | 62/5 |
| 5,607,011 | 3/1997 | Abdelmalek | 60/648 X |
| 5,685,154 | 11/1997 | Bronicki et al. | 60/648 |

*Primary Examiner*—Hoang Nguyen
*Attorney, Agent, or Firm*—Standley & Gilcrest LLP

[57] ABSTRACT

A method and system are described for heating natural gas in a station, such as a City Gate station. Natural gas from the field is generally transported via supply line at high pressure to the various distribution networks necessary for delivering the gas. However, before the natural gas can enter these distribution networks its pressure must be reduced to a usable level. City Gate stations employing pressure reducing (JT) valves are usually built for this purpose. The present invention provides a system and method for heating the natural gas, without combustion of the natural gas, by relying on the pre-existing pressure of the gas in the supply line along with particular equipment to provide heat to the gas passing through the station.

67 Claims, 3 Drawing Sheets

METHOD OF HEATING NATURAL GAS IN A CITY GATE STATION

BACKGROUND AND SUMMARY OF THE INVENTION

The present invention relates to a method of heating natural gas in preparation for a reduction in its pressure. In a natural gas distribution system, the gas generally travels from the field at relatively high pressure and velocity. Prior to introduction into the system that will deliver the gas to the end consumer, a pressure reduction must be accomplished. Pressure reduction stations, generally known as City Gate stations, are usually provided to perform this function. The City Gate stations use pressure-reducing valves, commonly known as JT valves, to reduce the gas pressure to a desired level.

In colder climates, the natural gas entering the City Gate station must undergo a heating process. Although the main supply lines entering a City Gate station are generally buried underground, they typically are not deep enough to be fully insulated from the effects of the ambient air temperature. Thus, in cold climates the temperature of the gas in the supply lines may approach freezing. Also, a natural result of the gas pressure reduction is a decrease in the gas temperature. This phenomenon is known as the Joule-Thompson effect. The larger the pressure reduction, the larger the decrease in gas temperature. The large pressure reductions generally performed in a City Gate station coupled with the often low temperature of the incoming natural gas may frequently result in a gas temperature, after pressure reduction, of below freezing. Such a temperature may be sufficient to freeze the small amounts of water that commonly travel with the natural gas, and also to cause a freezing of the JT valves. Thus, one aspect of the present invention is to employ a method for maintaining the temperature of the natural gas after pressure reduction at a level sufficient to prevent freezing.

In a typical City Gate station, the natural gas is generally heated by some method prior to entering the JT valves. The amount of heating required will depend on the pressure reduction necessary, and the temperature of the incoming natural gas. The amount of energy required for heating the natural gas may be substantial, especially in colder climates. In such a heating system, the natural gas itself is typically utilized as the energy source for generating the required heat.

The present invention provides a method for heating natural gas in a City Gate Station without requiring the burning of natural gas for producing the required heat. In a preferred embodiment of the invention, the system comprises a heat exchanger coupled to an air compressor that is powered by an air motor. The incoming natural gas, already naturally under pressure, is circulated through the heat exchanger where it picks up heat. The warmed gas exits the heat exchanger where it is divided into at least two paths. The majority of the gas passes directly to the JT valves, while a smaller portion travels through a reduced diameter conduit to the air motor. Because the warmed gas has a relatively high pressure and velocity, the air motor is able to generate enough power to drive the air compressor.

In one preferred embodiment of the present invention, an air cooled air compressor is preferably employed. The heated air stream leaving the air compressor is circulated through the heat exchanger to warm the heat exchanger's working fluid. Heat may be imparted to the compressed air stream by drawing heat from the air compressor itself, and the volumetric flow rate of the heated air may be increased by employing a device such as an air amplifier.

In another embodiment, a liquid-cooled air compressor is preferably used. However, instead of using the compressed air stream from the air compressor to warm the heat exchanger's working fluid as in the previous embodiment, the compressed air stream in the present embodiment is used to drive a second air motor. The second air motor powers a pump which circulates hot coolant from a portion of the air compressor to the heat exchanger. After circulating through the heat exchanger, the reduced temperature coolant is returned to the air compressor.

In a third embodiment, an oil-flooded rotary compressor is preferably utilized. The rotary compressor pumps a combined stream of heated oil and compressed air to the heat exchanger, where it is used to increase the temperature of the heat exchanger's working fluid. The oil and compressed air stream cools as it circulates through the heat exchanger, and then returns to the rotary compressor. The rotary compressor contains an oil separator which then separates the oil from the air.

DETAILED DESCRIPTION OF THE PREFERRED EMBODIMENTS

Figure 1:
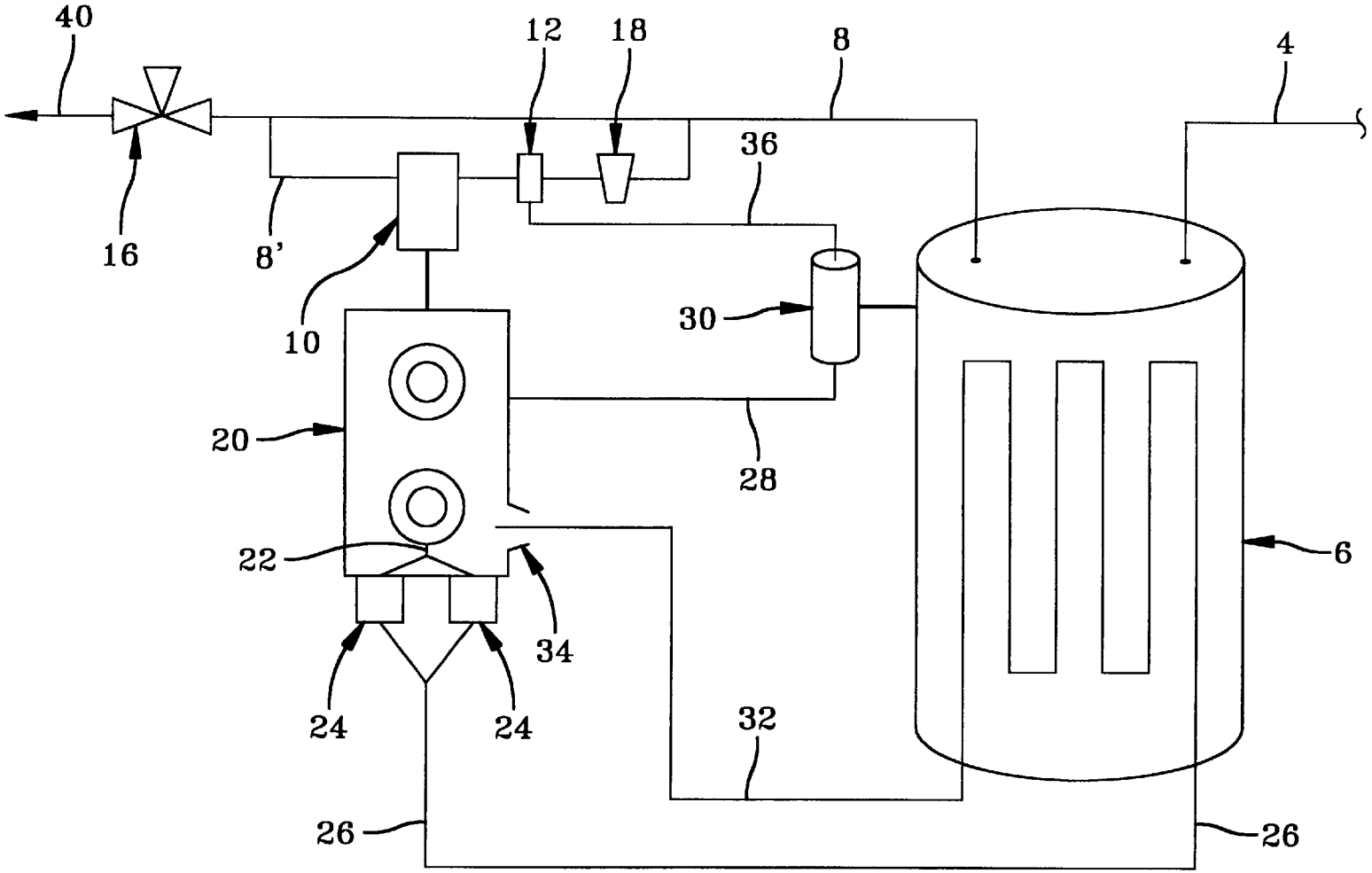
FIG. 1 depicts a preferred embodiment of the present invention in which an air motor powers an air cooled reciprocating compressor that is, in turn, used to heat the working fluid in a heat exchanger through which a supply line of natural gas passes.

FIG. 1 illustrates a preferred embodiment of the present invention. Natural gas from a main supply line 4 enters the City Gate station. The temperature of the gas in the main supply line 4 will vary depending upon the particular climate, but may be as low as approximately 35 degrees Fahrenheit. The natural gas from the main supply line 4 is directed into a heat exchanger 6. Heat exchangers of various design are well known. While the use of other types of heat exchangers is possible, each embodiment of the present invention contemplates a heat exchanger having a tank containing a working fluid which may be heated by an outside source. The natural gas is circulated through piping or other conduit within the heat exchanger 6, where it takes on heat from the heat exchanger's working fluid.

The heated natural gas stream 8 leaves the heat exchanger 6 where it is divided into at least two paths. The majority of the heated natural gas stream 8 travels directly to a pressure reducing valve 16, commonly referred to as a JT valve by those skilled in the art, while a smaller portion of the heated natural gas stream passes through a reduced diameter conduit to drive an air motor 10. Upon exiting the air motor 10, the heated natural gas stream 8' recombines with the heated natural gas stream 8 and enters the JT valve 16. Once the necessary pressure reduction is accomplished, the cooled, reduced pressure natural gas stream 40 is discharged to the distribution system for delivery to the consumer.

Preferably, there is a normally-open shut-off valve 12 through which the heated natural gas stream 8 passes prior to entering the air motor 10. The shut-off valve 12 is preferably connected to a temperature probe/relief valve 30 located on the heat exchanger 6. Upon a signal from the temperature probe/relief valve 30, the shut-off valve 12 will close, diverting the entire heated natural gas stream 8 directly into the JT valve 16, completely bypassing the air motor 10 and shutting down the air compressor 20. There is also, preferably, a filtering device 18 preceding the shut-off valve 12, such that the heated natural gas stream 8 is filtered for debris and condensation prior to entering the shut-off valve 12.

Because the pressure of the natural gas in the main line 4 may typically range from approximately 200 pounds per square inch to approximately 1500 pounds per square inch, the heated natural gas stream 8 enters the air motor 10 with sufficient velocity to allow the air motor to power an air compressor 20. The air compressor 20 is, preferably, a two-stage, air-cooled, reciprocating type, and is used to supply compressed, heated air to the heat exchanger 6 for heating the heat exchanger's working fluid. A compressed air stream 22 exits one outlet of the air compressor 20. The operation of the air compressor 20 naturally generates heat, therefore, by placing the air compressor 20 in an insulated enclosure, heat generated by the components of the air compressor may be imparted to the air stream 22 leaving the compressor. Additionally, depending on the conditions at a particular City Gate Station, the compressed air stream 22 may be directed into one or more air amplifiers 24 mounted on the air compressor enclosure. The heated air stream 26 leaves the air amplifiers 24 and enters the heat exchanger 6. The heated air stream 26 circulates through piping or other conduit within the heat exchanger 6, wherein it increases the temperature of the heat exchanger's working fluid.

Another compressed air stream 28 exits a second outlet of the compressor 20 and provides pressure to the temperature probe/relief valve 30. When the temperature inside the heat exchanger 6 exceeds a predetermined limit, the temperature probe/relief valve 30 opens, allowing a compressed air stream 36 to exit the temperature probe/relief valve and shift the position of the shut-off valve 12. The heated natural gas stream 8 will then bypass the air motor 10, temporarily shutting down the heating system until the temperature of the heat exchanger 6 drops below the predetermined limit.

As the heated air stream 26 circulates through the heat exchanger 6, its heat is removed to the working fluid. Therefore, the air stream 32 exiting the heat exchanger is cooler than when it entered. The cool air stream 32 is used to supply intake air to the compressor 20. Preferably, the compressor 20 has a regulating device 34 for controlling the volume of air entering the compressor.

Figure 2:
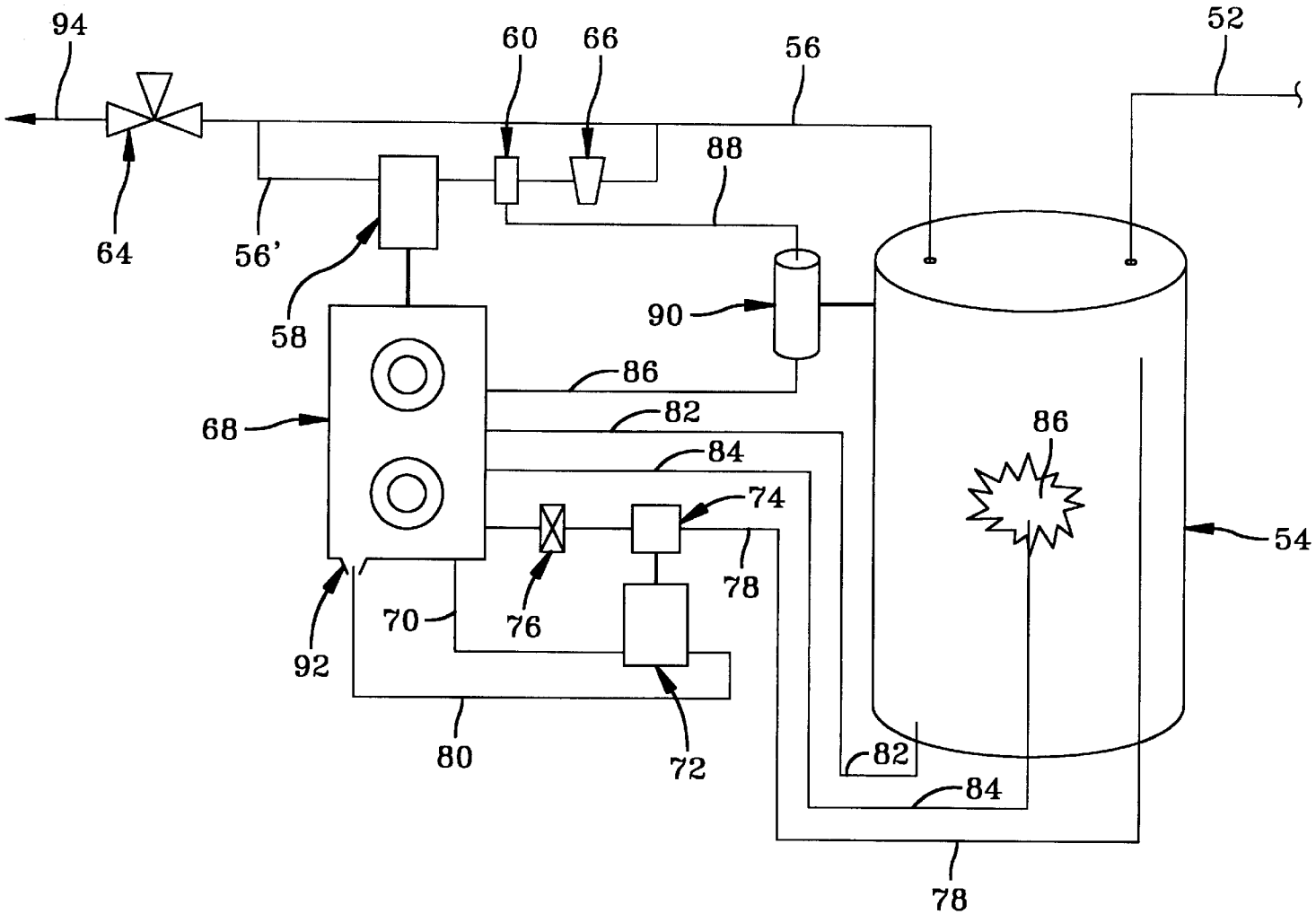
FIG. 2 depicts an alternate embodiment of the present invention in which an air motor powers a water cooled reciprocating compressor that is, in turn, used to heat the working fluid in a heat exchanger through which a supply line of natural gas passes.

An alternate embodiment of the present invention can be seen in FIG. 2. In this embodiment, natural gas from a main supply line 52 enters the City Gate station. The natural gas from the main supply line 52 passes through a heat exchanger 54 where it acquires heat from the heat exchanger's working fluid.

The heated natural gas stream 56 exits the heat exchanger 54 where it is divided into at least two paths. The majority of the heated natural gas stream 56 travels directly to a JT valve 64, while a smaller portion of the heated natural gas stream passes through a reduced diameter conduit to drive an air motor 58. Upon exiting the air motor 58, the heated natural gas stream 56' recombines with the heated natural gas stream 56 and enters the JT valve 64, where its pressure is reduced to the required level. The cooled, reduced pressure natural gas stream 94 then enters the distribution system that will eventually deliver it to the consumer.

Preferably, there is a normally-open shut-off valve 60 through which the heated natural gas stream 56 passes prior to entering the air motor 58. The shut-off valve 60 preferably communicates with the temperature probe/relief valve 90 located on the heat exchanger 54. Upon a signal from the temperature probe/relief valve 90, the shut-off valve 60 will close, diverting the entire heated natural gas stream 56 directly to the JT valve 64, completely bypassing the air motor 58 and shutting down the air compressor 68. There is also, preferably, a filtering device 66 preceding the shut-off valve 60 such that the heated natural gas stream 56 is filtered for debris and condensation prior to entering the shut-off valve 60.

The air compressor 68 utilized in this embodiment of the present invention is, preferably, a two-stage reciprocating type. Unlike the embodiment earlier described, however, the air compressor 68 is, preferably, of the liquid cooled variety. The compressor 68 contains passages for circulating coolant, commonly referred to as a water jacket, for regulating the temperature of the air compressor. The operation of the air compressor 68 naturally generates heat. By placing the air compressor 68 in an insulated enclosure, heat generated by the components of the air compressor may be transferred to the compressed air leaving the compressor.

A compressed air stream 70 exits one outlet of the air compressor 68. The compressed air stream 70 is used to power a second air motor 72. The second air motor 72 drives a coolant pump 74 that is used to circulate coolant between the heat exchanger 54 and the water jacket of the compressor 68. The compressed air stream 70 passes through the second air motor 72 and returns to the compressor 68 as a supply air stream 80. Preferably, the compressor 68 has a regulating device 92 for controlling the volume of supply air entering the air compressor.

The coolant pump 74 draws hot coolant 78 from the compressor 68 and transfers it to the tank of the heat exchanger 54, where it is used to heat the incoming natural gas from the main supply line 52. There is, preferably, a variable flow regulator 76 placed in line between the coolant pump 74 and the compressor 68. The variable flow regulator 76 functions to adjust the flow of coolant removed from the compressor 68 such that the temperature of the coolant in the heat exchanger 54 may be maintained at a desired level. The variable flow regulator 76 may be controlled by the temperature probe 90 attached to the heat exchanger 54, or may utilize some other control method. As the heated coolant 78 travels through the heat exchanger 54, much of its heat is transferred to the natural gas circulating therein. The lower temperature coolant 82 is removed from the heat exchanger 54 and returned to the water jacket on the air compressor 68 to maintain the compressor temperature.

A second compressed air stream 84 exits the compressor 68 and enters the heat exchanger 54. Preferably, the pipe or other conduit carrying the compressed air stream 84 protrudes some distance into the heat exchanger such that the compressed air stream 84 exits into the coolant in the heat exchanger 54 at some distance away from the bottom of the heat exchanger tank. The exiting compressed air stream 84 serves as an aerator 86 for the coolant in the heat exchanger 54, circulating the coolant to more uniformly distribute the heat supplied by the stream of hot coolant 78 from the air compressor 68.

An additional compressed air stream 86 is emitted from the compressor 54 to provide pressure to the temperature probe/relief valve 90 attached to the heat exchanger 54. When the temperature inside the heat exchanger 54 exceeds a predetermined limit, the relief valve portion of the temperature probe/relief valve 90 will open, allowing a compressed air stream 88 to exit the temperature probe/relief valve and shift the position of the shut-off valve 60. The heated natural gas stream 56 will then bypass the air motor 58, temporarily shutting down the heating system until the temperature of the heat exchanger 54 drops below the predetermined limit.

Figure 3:
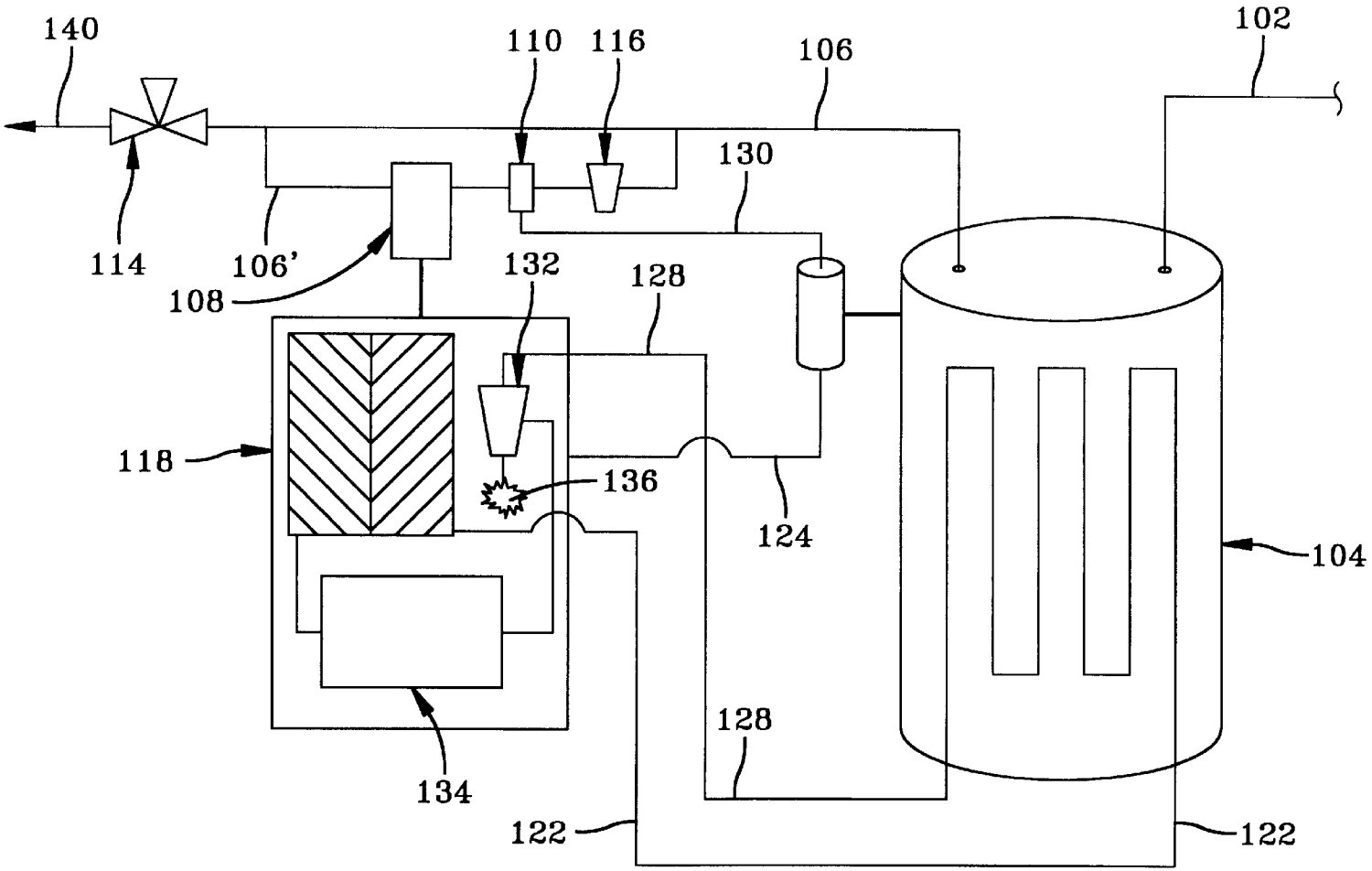
FIG. 3 depicts another embodiment of the present invention in which an air motor powers a rotary compressor that is, in turn, used to heat the working fluid in a heat exchanger through which a supply line of natural gas passes.

FIG. 3 depicts a third embodiment of the present invention. Natural gas from a main supply line 102 enters the City Gate station. The natural gas from the main supply line 102 is circulated through piping or other conduit within a heat exchanger 104, in order to draw heat from the heat exchanger's working fluid.

The heated natural gas stream 106 leaves the heat exchanger 104 where it is divided into at least two paths. The majority of the heated natural gas stream 106 travels directly to a JT valve 114, while a smaller portion of the heated natural gas stream passes through a reduced diameter conduit to drive an air motor 108. Upon exiting the air motor 108, the heated natural gas stream 106' recombines with the heated natural gas stream 106 and enters the JT valve 114 where it undergoes the necessary pressure reduction. The cooled, reduced pressure natural gas stream 140 then enters the distribution system for delivery to the consumer.

Preferably, there is a normally-open shut-off valve 110 through which the heated natural gas stream 106 passes prior to entering the air motor 108. The shut-off valve 110 is preferably connected to a temperature probe/relief valve 126 located on the heat exchanger 104. Upon a signal from the temperature probe/relief valve 126, the shut-off valve 110 will close, diverting the entire heated natural gas stream 106 directly into the JT valve 114, completely bypassing the air motor 108 and shutting down the air compressor 118. There is also, preferably, a filtering device 116 preceding the shut-off valve 110 such that the heated natural gas stream 106 is filtered for debris and condensation prior to entering the shut-off valve.

The air compressor 118 driven by the air motor 108 is, preferably, an oil-flooded, rotary type. More preferably, the compressor 118 is a twin-screw, oil-flooded, rotary type. The operation of the air compressor 118 naturally generates heat. By placing the air compressor 118 in an insulated enclosure, heat generated by the components of the air compressor may be transferred to the fluids leaving the compressor.

A stream of heated oil and compressed air 122 is pumped from the compressor 118 into the heat exchanger 104 where it is circulated through a series of conduit. The heat from the stream of heated oil and compressed air 122 is used to warm the working fluid located inside the heat exchanger tank.

A compressed air stream 124 is discharged from a second outlet of the compressor 118 and provides pressure to the temperature probe/relief valve 126. If the temperature inside the heat exchanger 104 exceeds a predetermined limit, the relief valve portion of the temperature probe/relief valve 126 will open, allowing a compressed air stream 130 exiting the temperature probe/relief valve to shift the position of the shut-off valve 110. The heated natural gas stream 106 will then bypass the air motor 108, temporarily shutting down the heating system until the temperature of the heat exchanger 104 drops below the predetermined limit.

The stream of heated oil and compressed air 122 will have a lower temperature after circulating through the heat exchanger 104. The cooled oil and compressed air stream 128 exits the heat exchanger 104 and returns to the compressor 118. The cooled oil and compressed air stream 128 enters an oil separator 132 wherein the oil is removed and returned to an oil reservoir 134. Preferably, the partially heated air 136 emitted from the oil separator 132 is exhausted into the air compressor enclosure.

It can be seen that the system of the present invention requires no combustion of an energy source to provide heating of the natural gas entering the City Gate station. Rather, the system utilizes the already present velocity and pressure in the incoming natural gas stream to power other components that, in turn, act to heat the natural gas. Based upon the climate and other conditions existing at a particular City Gate station, component size and other factors may be calculated to produce the desired temperature of the natural gas after pressure reduction.

For purposes of illustration, and not limitation, it should be realized that different, or additional sensors may be employed to monitor conditions at other locations within the system of the present invention. Such sensors could provide additional feedback for regulating the various components of the system.

The scope of the invention is not to be considered limited by the above disclosure, and modifications are possible without departing from the spirit of the invention as evidenced by the following claims.

What is claimed is:

1. A method of heating natural gas in preparation for pressure reduction at a station, said method comprising the steps of:

circulating natural gas from a main supply line through at least one heat exchanger to heat said natural gas;

extracting a portion of said heated natural gas leaving said heat exchanger to drive at least one air motor;

recombining the natural gas exiting said air motor with said natural gas from said heat exchanger;

providing said recombined, heated natural gas to at least one valve, said valve adapted to reduce the pressure of said natural gas to a desired level;

employing said at least one air motor to drive an air compressor;

supplying the heated air generated by said air compressor to said heat exchanger; and withdrawing the cooled air from said heat exchanger and returning it to said air compressor.

2. The method of claim 1 wherein said air compressor is a reciprocating type.

3. The method of claim 2 wherein said air compressor is a two-stage type.

4. The method of claim 3 wherein said air compressor is air cooled.

5. The method of claim 1 wherein said heated, compressed air generated by said air compressor is supplied to at least one air amplifier to increase its volumetric flow rate prior to entering said heat exchanger.

6. The method of claim 1 wherein said air compressor is adapted to regulate its ambient air intake.

7. The method of claim 1 wherein a diverting device exists to route said heated natural gas directly into said valve while bypassing said air motor.

8. The method of claim 1 wherein said heated natural gas passes through a filtering device prior to entering said diverting device, said air motor, or said valve.

9. The method of claim 1 wherein a sensing device is adapted to monitor the temperature of said heat exchanger.

10. The method of claim 9 wherein said sensing device is further adapted to regulate said temperature of said heat exchanger.

11. The method of claim 10 wherein said sensing device is further coupled to said diverting device, said diverting device designed to operate in response to a signal from said sensing device.

12. The method of claim 1 including the step of regulating the amount of heat transferred to said natural gas, so that the temperature of said natural gas leaving said valve is within a predetermined range.

13. The method of claim 1 wherein said air compressor resides within an insulated enclosure.

14. The method of claim 1 wherein heat generated by the operation of said air compressor is imparted to the compressed air output from said air compressor.

15. The method of claim 1 including a sensor for monitoring the temperature of said natural gas entering said station.

16. The method of claim 1 including a sensor for monitoring the pressure of said natural gas entering said station.

17. The method of claim 1 including a sensor for monitoring the temperature of the heated natural gas exiting said heat exchanger.

18. The method of claim 1 including a sensor for monitoring the temperature of said natural gas after pressure reduction in said valve.

19. A method of heating natural gas in preparation for pressure reduction at a station, said method comprising the steps of:

circulating natural gas from a main supply line through at least one heat exchanger to heat said natural gas;

extracting a portion of said heated natural gas leaving said heat exchanger to drive a first air motor;

recombining the natural gas exiting said air motor with said heated natural gas from said heat exchanger;

providing said recombined, heated natural gas to at least one valve, said valve adapted to reduce the pressure of said natural gas to a desired level;

employing said first air motor to drive a liquid-cooled air compressor;

supplying the compressed air generated by said air compressor to a second air motor, said second air motor adapted to drive a pump for circulating coolant;

returning the air exhausted from said second air motor to said air compressor;

using said pump to supply hot coolant from a portion of said air compressor to said heat exchanger; and using said pump to withdraw coolant at a reduced temperature from said heat exchanger and return it to said portion of said air compressor.

20. The method of claim 19 wherein said air compressor is a reciprocating type.

21. The method of claim 19 wherein said air compressor is adapted to regulate its ambient air intake.

22. The method of claim 19 wherein a diverting device exists to route said heated natural gas directly into said valve while bypassing said air motor.

23. The method of claim 19 wherein said heated natural gas passes through a filtering device prior to entering said diverting device, said air motor, or said valve.

24. The method of claim 19 wherein a sensing device is adapted to monitor the temperature of said heat exchanger.

25. The method of claim 24 wherein said sensing device is further adapted to regulate said temperature of said heat exchanger.

26. The method of claim 25 wherein said sensing device is further coupled to said diverting device, said diverting device designed to operate in response to a signal from said sensing device.

27. The method of claim 19 wherein a regulating device resides between the heated coolant outlet of said air compressor and the inlet of said pump, said regulating device adapted to adjust the flow of coolant removed from said air compressor.

28. The method of claim 19 wherein a compressed air stream is provided for aerating the coolant within said heat exchanger.

29. The method of claim 19 including the step of regulating the amount of heat transferred to said natural gas, so that the temperature of said natural gas leaving said valve is within a predetermined range.

30. The method of claim 19 wherein said air compressor resides within an insulated enclosure.

31. The method of claim 19 wherein heat generated by the operation of said air compressor is imparted to the coolant and compressed air output from said air compressor.

32. A method of heating natural gas in preparation for pressure reduction at a station, said method comprising the steps of:

circulating natural gas from a main supply line through at least one heat exchanger to heat the natural gas;

extracting a portion of said heated natural gas leaving said heat exchanger to drive at least one air motor;

recombining the natural gas exiting said air motor with said natural gas from said heat exchanger;

providing said recombined, heated natural gas to at least one valve, said valve adapted to reduce the pressure of said natural gas to a desired level;

employing said air motor to drive an oil-flooded rotary air compressor;

discharging a combination of heated oil and compressed air generated by said air compressor to said heat exchanger; and withdrawing the cooled combination of oil and compressed air from said heat exchanger and returning it to said air compressor.

33. The method of claim 32 wherein said air compressor is a twin-screw type.

34. The method of claim 32 wherein a diverting device exists to route said heated natural gas directly into said valve, while bypassing said air motor.

35. The method of claim 32 wherein said heated natural gas passes through a filtering device prior to entering said diverting device, said air motor, or said valve.

36. The method of claim 32 wherein a sensing device is adapted to monitor the temperature of said heat exchanger.

37. The method of claim 36 wherein said sensing device is further adapted to regulate said temperature of said heat exchanger.

38. The method of claim 37 wherein said sensing device is further coupled to said diverting device, said diverting device designed to operate in response to a signal from said sensing device.

39. The method of claim 32 including the step of regulating the amount of heat transferred to said natural gas, so that the temperature of said natural gas leaving said valve is within a predetermined range.

40. The method of claim 32 wherein said air compressor resides within an insulated enclosure.

41. The method of claim 32 wherein heat generated by the operation of said air compressor is imparted to the oil and compressed air output from said air compressor.

42. The method of claim 32 wherein said air compressor includes a device for separating the oil from the air returned to said air compressor from said heat exchanger.

43. The method of claim 42 wherein at least a portion of said separated air is exhausted into said insulated enclosure.

44. The method of claim 32 wherein said air compressor includes an oil reservoir.

45. The method of claim 32 including a sensor for monitoring the temperature of said natural gas entering said station.

46. The method of claim 32 including a sensor for monitoring the pressure of said natural gas entering said station.

47. The method of claim 32 including a sensor for monitoring the temperature of the heated natural gas exiting said heat exchanger.

48. The method of claim 32 including a sensor for monitoring the temperature of said natural gas after pressure reduction in said valve.

49. A system for heating natural gas in a station, said system comprising:

at least one heat exchanger for receiving natural gas flow from a supply line;

at least one air motor for receiving a portion of said natural gas exiting said heat exchanger, said at least one air motor adapted to drive at least one air compressor; and at least one air compressor driven by the output of said at least one air motor, said at least one air compressor adapted to discharge a heated fluid to said heat exchanger, thereby providing a heat source for increasing the temperature of said natural gas passing through said station.

50. The system of claim 49 wherein said air compressor is a reciprocating type.

51. The system of claim 50 wherein said air compressor is air-cooled.

52. The system of claim 50 wherein said air compressor is liquid-cooled.

53. The system of claim 49 wherein said air compressor is an oil-flooded rotary type.

54. The system of claim 51 wherein at least one air amplifier is used to increase the volumetric flow rate of the air leaving said air compressor.

55. The system of claim 52 wherein a portion of the compressed air discharged by said air compressor is used to drive a second air motor.

56. The system of claim 55 wherein said second air motor powers a pump for removing hot coolant from said air compressor, and circulates said hot coolant through said heat exchanger and back to said air compressor.

57. The system of claim 51 or claim 52 wherein said air compressor is adapted to regulate its ambient air intake.

58. The system of claim 49 including at least one valve for receiving a portion of said natural gas exiting said heat exchanger, said at least one valve adapted to reduce the pressure of said natural gas to a desired level.

59. The system of claim 58 including a diverting device for routing said natural gas directly from said heat exchanger to said at least one valve, while bypassing said air motor.

60. The system of claim 49 including a sensing device for monitoring the temperature of said heat exchanger.

61. The system of claim 60 wherein said sensing device is adapted to regulate the temperature of said heat exchanger.

62. The method of claim 61 wherein said sensing device is further coupled to said diverting device, said diverting device designed to operate in response to a signal from said sensing device.

63. The system of claim 49 including a sensor for monitoring the temperature of said natural gas entering said station.

64. The system of claim 49 including a sensor for monitoring the pressure of said natural gas entering said station.

65. The system of claim 49 including a sensor for monitoring the temperature of the heated natural gas exiting said heat exchanger.

66. The system of claim 58 including a sensor for monitoring the temperature of said natural gas after pressure reduction in said valve.

67. A method for heating natural gas at a station, said method comprising the steps of:

providing at least one heat exchanger for receiving natural gas flow from a supply line;

employing at least one air motor for receiving a portion of said natural gas exiting said heat exchanger, said at least one air motor adapted to drive at least one air compressor; and utilizing said at least one air compressor driven by the output of said at least one air motor, said at least one air compressor adapted to discharge a heated fluid to said heat exchanger, thereby providing a heat source for increasing the temperature of said natural gas passing through said station.

* * * * *